US010279390B2

(12) United States Patent
Colombo et al.

(10) Patent No.: US 10,279,390 B2
(45) Date of Patent: May 7, 2019

(54) APPARATUS AND METHOD FOR PRODUCTION OF LONG METAL PRODUCTS

(71) Applicant: Primetals Technologies Austria GmbH, Linz (AT)

(72) Inventors: Ezio Colombo, Milan (IT); Gerald Hohenbichler, Kronstorf (AT); Jens Kluge, Aichach (DE); Jeffrey Morton, Alberndorf i.d. Riedmark (AT); Paul Pennerstorfer, Thalheim/Wels (AT)

(73) Assignee: PRIMETALS TECHNOLOGIES AUSTRIA GMBH (AT)

( * ) Notice: Subject to any disclaimer, the term of this patent is extended or adjusted under 35 U.S.C. 154(b) by 210 days.

(21) Appl. No.: 15/127,208

(22) PCT Filed: May 4, 2015

(86) PCT No.: PCT/EP2015/059676
§ 371 (c)(1),
(2) Date: Sep. 19, 2016

(87) PCT Pub. No.: WO2015/173043
PCT Pub. Date: Nov. 19, 2015

(65) Prior Publication Data

US 2017/0106437 A1 Apr. 20, 2017

(30) Foreign Application Priority Data

May 13, 2014 (EP) ..... 14425057

(51) Int. Cl.
*B22D 11/20* (2006.01)
*B21B 1/46* (2006.01)
(Continued)

(52) U.S. Cl.
CPC ..... *B22D 11/20* (2013.01); *B21B 1/466* (2013.01); *B21B 39/004* (2013.01);
(Continued)

(58) Field of Classification Search
CPC ..... B22D 11/14; B22D 11/147; B22D 11/20; B21B 1/46; B21B 1/466; B21B 39/004
See application file for complete search history.

(56) References Cited

U.S. PATENT DOCUMENTS 3,648,359 A * 3/1972 Dennis ..... B21B 1/466 164/263
4,289,944 A * 9/1981 Reese ..... C21D 9/0018 164/154.3
(Continued)

FOREIGN PATENT DOCUMENTS

CN 1168302 A 12/1997
CN 102294356 A 12/2011
(Continued)

OTHER PUBLICATIONS

Chinese Office Action, dated Dec. 1, 2017, issued in corresponding Chinese Patent Application No. 201580024841.9. Including English translation. Total 11 pages.
(Continued)

*Primary Examiner* — Kevin E Yoon
(74) *Attorney, Agent, or Firm* — Ostrolenk Faber LLP

(57) ABSTRACT

An apparatus (100) and method for the production of elongated metal products such as bars, rods or the like: A rolling mill (10) with at least one rolling stand (5); a casting station (20) with at least a first casting line (2*a*) and at least a second casting line (2*b*), each line (2*a*, 2*b*) being operable to produce respective elongated intermediate products (b2*a*, b2*b*), such as billets; wherein at least the first casting line (2*a*) is directly aligned with the rolling mill (10), the first
(Continued)

casting line (2*a*) being configured to feed the rolling mill (10) with a fully continuous casting strand or with cast elongated intermediate products; and the second casting line (2*b*) is not aligned with the rolling mill (10). A bidirectional transfer device (30) for transferring elongated intermediate products (b2*b*) of the second casting line (2*b*) alternatively in a first direction from the second casting line (2*b*) to the first casting line (2*a*) to align the elongated intermediate product (b2*b*) with the rolling mill (10) or in a second direction from the at least second casting line (2*b*) to a cooling bed (40).

13 Claims, 5 Drawing Sheets

(51) Int. Cl.

| | |
|---|---|
| ***F27B 9/24*** | (2006.01) |
| ***B21B 39/00*** | (2006.01) |
| ***B22D 11/043*** | (2006.01) |
| ***B22D 11/128*** | (2006.01) |
| ***B22D 11/14*** | (2006.01) |
| *B21B 15/00* | (2006.01) |

(52) U.S. Cl.
CPC ..... *B22D 11/043* (2013.01); *B22D 11/1282* (2013.01); *B22D 11/142* (2013.01); *B22D 11/147* (2013.01); *F27B 9/2407* (2013.01); *B21B 2015/0014* (2013.01)

(56) References Cited

U.S. PATENT DOCUMENTS

| | | | | |
|---|---|---|---|---|
| 5,787,565 | A | 8/1998 | Matsuo | 29/526.4 |
| 5,924,184 | A | 7/1999 | Donini | 29/527.7 |
| 6,282,767 | B1 | 9/2001 | Borsi et al. | |
| 6,289,972 | B1 | 9/2001 | Benedetti | |
| 8,322,400 | B2 | 12/2012 | Benedetti | 164/460 |
| 2004/0025320 | A1* | 2/2004 | Seidel | B21B 1/466 29/527.7 |
| 2009/0298001 | A1* | 12/2009 | Klein | B22D 11/1213 432/11 |
| 2013/0112365 | A1* | 5/2013 | Colombo | B22D 11/14 164/476 |
| 2017/0002439 | A1* | 1/2017 | Benedetti | B21B 1/466 |

FOREIGN PATENT DOCUMENTS

| | | | |
|---|---|---|---|
| EP | 0 770 433 | A1 | 5/1997 |
| FR | 2137483 | A1 | 12/1972 |
| JP | H09-66301 | A | 3/1997 |
| RU | 2044581 | C1 | 9/1995 |
| RU | 2010135760 | A | 2/2012 |
| SU | 384292 | A1 | 12/1977 |
| WO | WO 00/71271 | A1 | 11/2000 |
| WO | WO 2012/013456 | A2 | 2/2012 |

OTHER PUBLICATIONS

Japanese Office Action, dated Dec. 25, 2017, issued in corresponding Japanese Patent Application No. 2016-567414. Including English translation. Total 21 pages.
International Search Report dated Aug. 7, 2015 issued in corresponding International patent application No. PCT/EP2015/059676.
Written Opinion dated Aug. 7, 2015 issued in corresponding International patent application No. PCT/EP2015/059676.
Office Action dated Nov. 1, 2018 issued in corresponding Russian Application No. 2016148313 with English translation.

* cited by examiner

APPARATUS AND METHOD FOR PRODUCTION OF LONG METAL PRODUCTS

CROSS-REFERENCE TO RELATED APPLICATIONS

The present application is a 35 U.S.C. §§ 371 national phase conversion of PCT/EP2015/059676, filed May 4, 2015 which claims priority of European Patent Application No. 14425057.8, filed May 13, 2014, the contents of which are incorporated by reference herein. The PCT International Application was published in the English language.

TECHNICAL FIELD

The present invention relates to an apparatus and a method for production of elongated metal products such as bars, rods, wire and the like.

TECHNICAL BACKGROUND

The production of elongated metal products is generally realized in a plant by a succession of steps. Normally, in a first step, metal scrap is provided as feed material to a furnace which heats up the scrap to reach the liquid status. Afterwards, continuous casting equipment is used to cool and solidify the liquid metal and to form a suitably sized strand.

Such a strand may then be cut to produce a suitably sized intermediate elongated product, typically a billet, to create feeding stock for a rolling mill. Normally, such feeding stock is then cooled down in cooling beds. Thereafter, a rolling mill is used to transform the feed stock, or billet, to a final elongated product, for instance rebar, available in different sizes which can be used in mechanical or construction industry. To obtain this result, the feed stock is pre-heated to a temperature which is suitable for entering the rolling mill where it is to be rolled by rolling equipment including multiple stands. By rolling the feed stock through these multiple stands, the feed stock is reduced to the desired cross section and shape. The elongated product resulting from the former rolling process is normally cut when it is still in a hot condition, then cooled down in a cooling bed, and finally cut at a commercial length and packed to be ready for delivery to a customer.

In the following, an endless operational mode of a plant for manufacturing elongated metal products will denote a plant arrangement wherein a direct, continuous link is established between a casting station and the rolling mill which is fed with the product of the casting procedure. In other words, the strand of intermediate product leaving the casting station is rolled by the rolling mill continuously along one casting line. Normally, when a plant operates in a fully endless mode, the continuous strand that is cast from the casting station along a corresponding casting line is fed to rolling mill, without being preliminarily cut into billets. In this case, the elongated intermediate product comes to effectively coincide with the strand leaving the casting station.

In the following, a semi-endless operational mode of a plant for manufacturing of elongated metal products denotes a plant arrangement, wherein the rolling mill is also fed with supplemental, normally preliminarily cut intermediate products which are originally external to the casting line directly linked to the rolling mill. Such intermediate products can be fed and inserted into the casting line which is directly connected to the rolling mill, for instance, by sourcing them from further casting lines which are not necessarily themselves aligned with and directly linked to the rolling mill.

When operating according to a so called endless mode, the rolling mill is arranged aligned with the strand produced by the billet caster. As a result, a manufacturing plant comprising direct casting and direct feeding of rolling mills, when dimensioned and conceived for operating in such endless mode, should ideally be as short as possible, in order to optimally utilize the internal heat of the just cast billets. Following this construction constraint, the space interposed between a first shear, normally located at the end of the caster, and an entrance into a customary intermediate billet heating device should be kept as short as possible. The compactness requirement remains naturally very desirable also when operating in a semi-endless mode.

Document WO 2012/013456 A2 discloses a plant comprising two casting lines producing two strands of intermediate product, such as billets. Such a plant provides a preliminary solution to the problem of better exploiting the hourly production rate of the steelmaking plant upstream, which is usually higher than the conventional production rate of rolling mills downstream. However, the layout of this plant is such that only one of two strands can be rolled to obtain a final product. By adopting a by-pass solution according to the concept disclosed in WO 2012/013456 A2, if there is at least a further strand available exiting from a caster, the additional billets resulting from such further strand are just transferred onto a conventional cooling bed. The billets which have been cooled down on such bed are then normally intended for direct sale and are not rolled according to an endless operational mode. Such a plant does therefore not provide optimal operational flexibility to be run either in a fully endless mode or in semi-endless mode.

In particular, such a plant does not allow fully exploiting the potentialities of a multi-strand caster in a way that the rolling mill throughput is actually optimized, for the production of as many rolled, final elongated products as desired.

On the other hand, existing plants which are able to operate in the so called semi-endless mode cannot ensure that the operation of inserting extra-billets into the casting line directly connected to the rolling mill happens in a cobble-free fashion and with full control over the billets' movements, both along the additional casting lines from which the supplemental billets are sourced and, especially, along the main casting line which is directly connected to the rolling mill.

None of the existing plants which can operate in a semi-endless mode and have a multi-strand caster effectively deal with the problem of avoiding that interferences are created between billets along the casting lines.

As a result of such lack of control, in current plants operating in a semi-endless mode, the workflow can be disrupted, in the feeding direction of the rolling mill as well as in the additional casting lines which are not aligned with the rolling mill.

Thus, a need exists in the prior art for an apparatus, and a corresponding method, for the production of elongated rolled products from a multiplicity of casting lines which encompasses a semi-endless operating mode, wherein the rolling mill output and the production rate of intermediate elongate products such as billets are optimized and happen in a cobble-free way, that is with no interferences between billets on one same casting line or across casting lines as a result of billet transfer.

SUMMARY OF THE INVENTION

Accordingly, a major objective of the present invention is to provide a flexible plant and a method for production of long metal products which allows switching between endless and semi-endless production mode. The present invention allows thus to exploit at the best, in terms of output, the potentiality of a multi-line caster in direct association with a rolling mill and, at the same time, offers the option to seamlessly produce intermediate elongate products, such as billets to be sold as such.

The plant according to the present invention operates in a way that it can swiftly adapt to different production requirements and circumstances, dependent on actual need of final elongated products, such as rolled rebars, or intermediate elongated products, such as billets as such. This way, production can be adjusted to the current, actual requests, for instance according to commission orders.

The present invention allows increasing rolling throughput by feeding the rolling mill with as many billets as possible from at least two, three or even N strands, without losing control over the production process and specifically over the billet movements.

A companion objective of the present invention is to allow reaching the above flexibility while at the same time keeping the overall plant very compact.

In this respect, the movements of the billets along the casting line directly connected to rolling mill and the movements of billets on the additional casting lines are achieved and controlled according to a special arrangement which does not have negative consequences in terms of overall length and general bulk of the plant.

In particular, such movements of elongated intermediate products, both across the casting line directly linked to the rolling mill and the additional casting lines and from the additional casting lines to a cooling bed, can be advantageously executed by operating the same double-acting transfer means, positioned at the same level along the overall development of the plant production line.

There is no need for an add-on to the plant resulting in a supplementary length least equal to the length of a billet, like customary solutions would instead imply.

It is also by adopting this arrangement measure that the present invention ensures that the temperature of the cast billets or intermediate elongated products does not decrease too much along the production lines. Less power is thus needed to re-heat the intermediate elongated products to a temperature that is suitable for subsequent hot rolling, in compliance with more and more relevant energy saving measures and ecological requirements.

A companion objective of the present invention is to readily switch between semi-endless and endless production modes on the casting line directly connected to the rolling mill by use of a robust system which does not present unnecessary complications, thus reducing need for maintenance and extra-safety measures.

Decoupling the billet transfer means from the billet heating means according to the plant arrangement of the present invention advantageously ensures that the mechanical and control parts of the bidirectional, also denotable as double acting, billet transfer means are not affected by high temperatures.

Easier accessibility to these transfer means, even during operation, is achieved.

Other objectives, features and advantages of the present invention will be now described in greater detail with reference to specific embodiments represented in the attached drawings, wherein:

DESCRIPTION OF EMBODIMENTS

Figure 1:
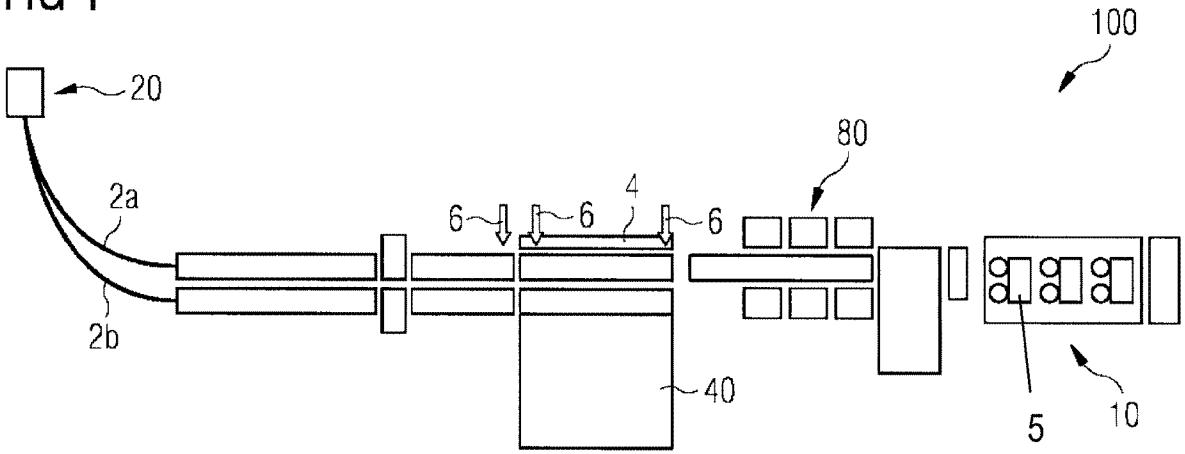
FIG. 1 is a schematic, general view of an embodiment of the apparatus according to the present invention, wherein the casting station produces a first and a second casting strand, substantially parallel to each other, travelling on respective casting lines.

In the FIGS., like reference numerals depict like elements.

With reference to FIG. 1, an apparatus 100 for the production of elongated metal products such as bars, rods or the like, comprises:

- a rolling mill 10 comprising at least one rolling stand 5; and
- a casting station 20 comprising at least a first casting line 2*a* and at least a second casting line 2*b*.

Figure 2:
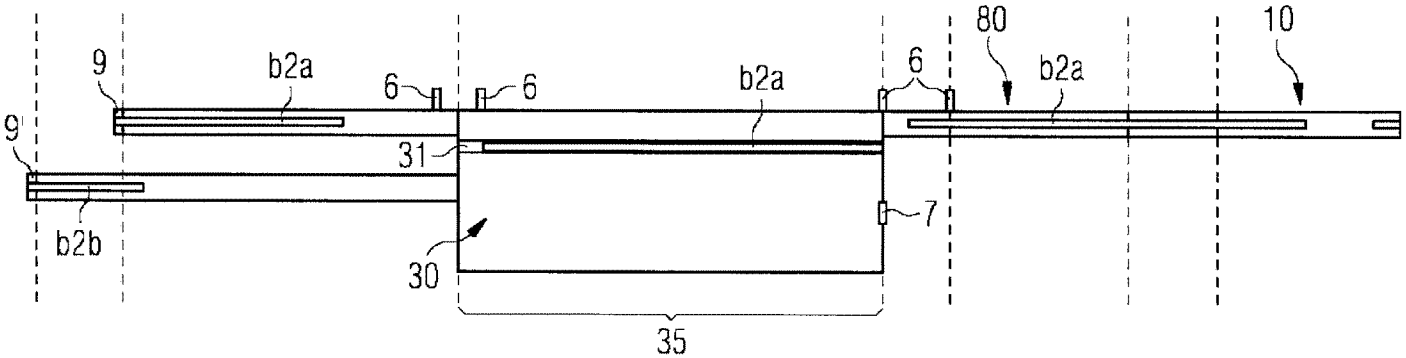
FIG. 2 is a schematic view of a portion of the apparatus of FIG. 1, showing a particular moment of the cross-transfer of an elongated intermediate product, such as a billet, from the second casting line to the first casting line.
Figures 3A, 3B, 3C, 3D, 3E:
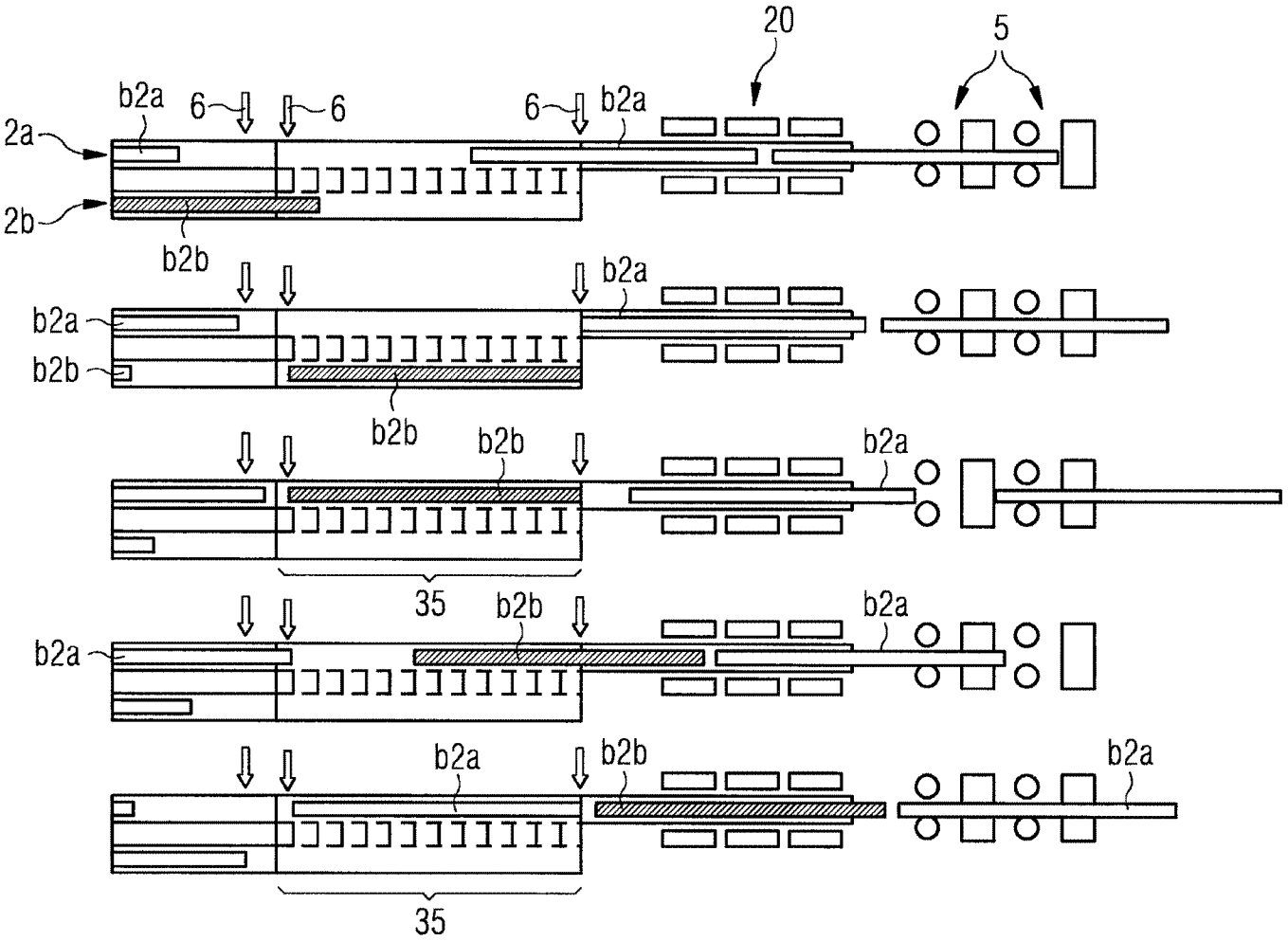
FIGS. 3A, 3B, 3C, 3D and 3E are schematic representations of a first sequence of steps executed by the apparatus of FIG. 1, showing how the elongate intermediate products moving on the first casting line are complemented with additional elongated intermediate products from the second casting line, when minimal conditions of non-interference are satisfied.

Each of the casting lines 2*a* and 2*b* is operable to produce respective continuous strands and/or elongated intermediate products b2*a*, b2*b* in FIG. 2, such as billets.

In FIGS. 1 and 2, the first casting line 2*a* is directly aligned with the rolling mill 10 and is configured to feed such rolling mill 10 with cast continuous strands or elongated intermediate products.

According one of the functioning concepts of the present invention, the elongated intermediate products which eventually feed the rolling mill 10 can advantageously be billets b2*a* as well as billets b2*b*.

The at least one second casting line 2*b* is, instead, not directly aligned with the rolling mill 10.

In FIG. 2, the apparatus 100 according to the present invention further advantageously comprises double acting, or bidirectional, transfer means 30 for transferring elongated intermediate products across the multiplicity of casting lines.

In particular, for the specific embodiment hereby illustrated, such bidirectional transfer means 30 allows the cross-transfer of elongated intermediate products b2*b* of the second casting line 2*b* in two possible, preferably opposite directions.

Specifically, the transfer of billets b2*b* can be executed in a first direction, from the second casting line 2*b* to the first casting line 2*a*, in order to align the elongated intermediate product b2*b* with the rolling mill 10, to be finally rolled according to a semi-endless operating mode.

Otherwise, alternatively, the special bidirectional transfer means 30 of the apparatus 100 according to the present invention can transfer billets b2*b* in a second direction, preferably substantially opposite to the first direction, from the at least second casting line 2*b* to a cooling bed 40.

Billets b2*b* which are transferred to a cooling bed according to this second transfer option are then meant to be sold as intermediate product, that is billets as such, to be then further processed, possibly on a different site.

In this way, the overall, multi-line billet manufacturing plant can be switched between different operating modes. In particular, the plant comprising the claimed apparatus 100 can be automatically, swiftly switched, for instance, between:

- a semi-endless operating mode wherein an exchange of elongated intermediate products between second casting line 2*b* and first casting line 2*a* is implemented, to achieve a consistently higher output of the rolling process; and
- a fully endless operating mode only on the first casting line aligned with the rolling mill 10, usually with the benefit of less specific reheating energy consumption and/or better material yield by the whole process.

Figure 6:
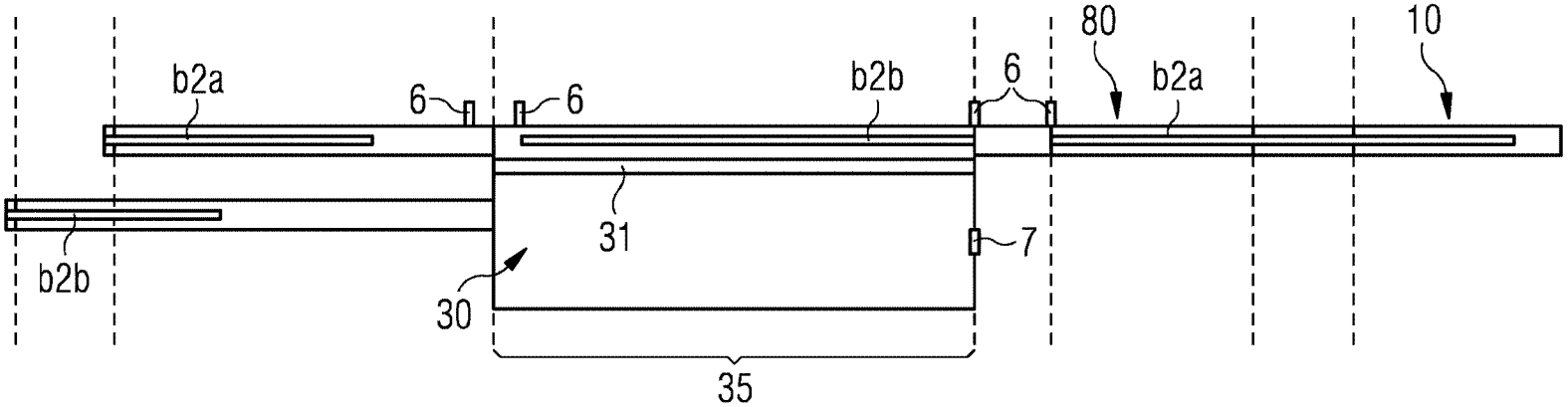
FIG. 6 is a schematic representation of one of the steps which can be performed by the apparatus of FIG. 1, showing how a lifting device of bidirectional transfer means of the apparatus according to the present invention, having carried an elongated intermediate product from the second casting line to the first casting line, is brought back towards a waiting position along the second casting line

On the one hand, when functioning according to a semi-endless mode, billets b2*a* originally put from the casting station 20 on the first casting line 2*a* are complemented with cross-transferred billets b2*b* from (at least) a second casting line 2*b*, as shown in FIG. 6, thus obtaining that these cross-transferred billets arrive at the rolling mill 10. Hence all billets from both casting lines can be rolled.

Figures 4A, 4B, 4C, 4D, 4E:
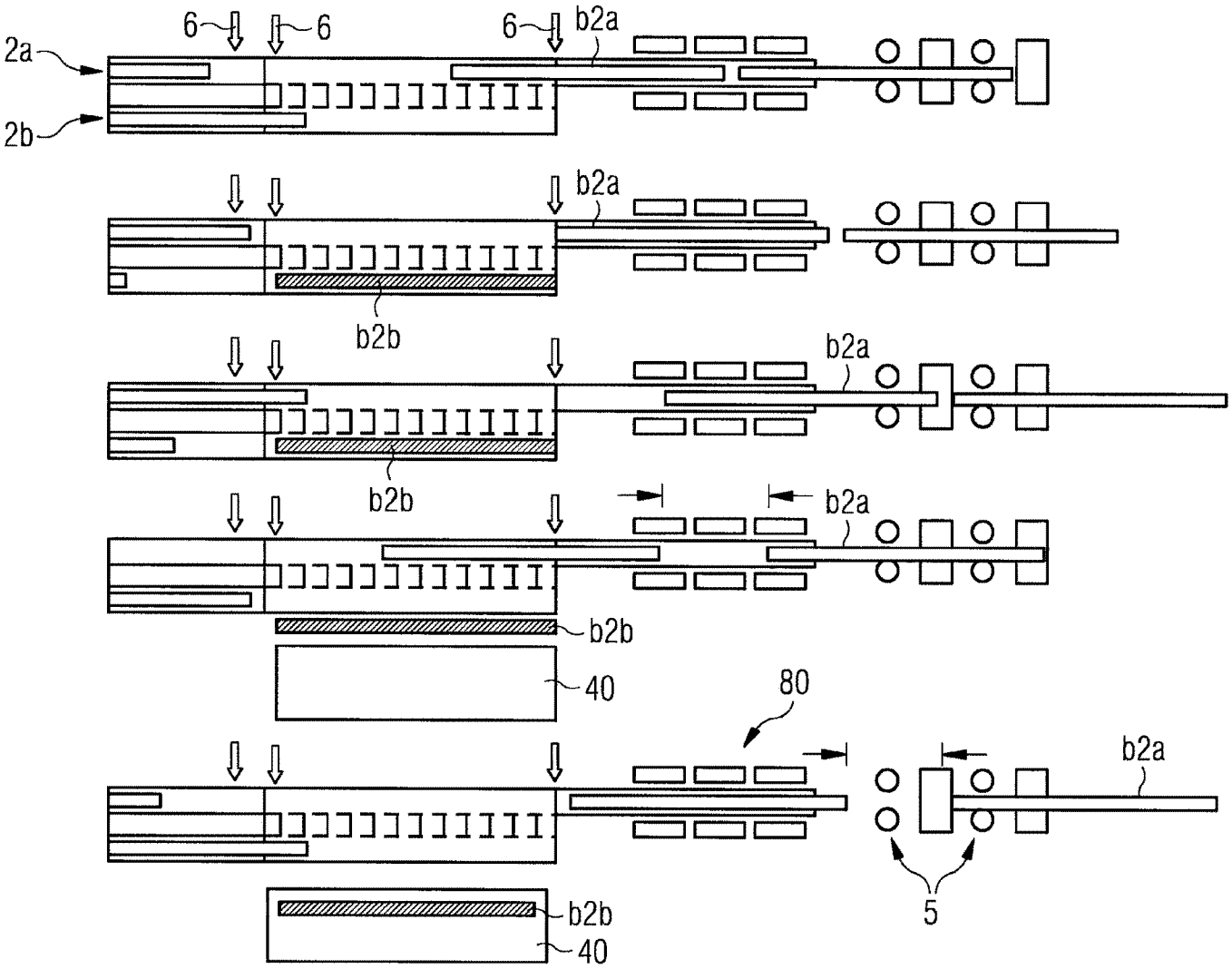
FIGS. 4A, 4B, 4C 4D and 4E are schematic representations of a second sequence of steps executed by the apparatus of FIG. 1, showing how elongated intermediate products from the second casting line are cross-transferred to a cooling bed, when minimal conditions of non-interference are not satisfied either on the second casting line or on the first casting line.

On the other hand, when the first casting line operates in a fully endless mode, billets b2*b* originally on the second casting line 2*b* are, instead, transferred onto a cooling bed 40 in FIGS. 4D, 4E and do not reach the rolling mill 10, and are available to be sold or for later heating of other billets. Hence, maximum material yield together with minimum specific heating energy consumption is obtained.

The operating mode of the first casting line can be turned to a fully endless mode when for example, commission orders demand that, from multi-strand continuous casting production. The billets obtained from the non-aligned strands may be sold as mere, unrolled intermediate product.

According to the present invention, switching from a semi-endless operating mode to an operating mode which is essentially endless along the first, aligned casting line is also preferably dependent on the relative movement of the elongated intermediate products and, ultimately, on risk of interference among billets on the first casting line and/or on the second casting line.

The switching between operating modes can be therefore advantageously controlled in function of minimal conditions of non-interference between billets, as explained more in depth below in connection with the description of the process steps according to the present invention.

In fact, the present invention allows to optimize and customize production output, ensuring cobble-free conditions on the first casting line and on the other, additional casting lines, by avoiding interferences between billets on the first casting line and/or on the further casting lines. Such undesirable interferences would otherwise cause problems both as a result of subsequent, incoming billets on the same casting line or as a result of the insertion of additional billets into the first casting line aligned with the rolling mill.

The bidirectional transfer means 30 in FIGS. 2 and 6 of the apparatus 100 according to the present invention comprises preferably a lifting device 31 for carrying elongated intermediate products b2*b*. Such lifting device can comprise an aptly designed billet seat.

Bidirectional, or double acting, transfer means can comprise first and second moving means cooperating with the lifting device 31.

First moving means allow transferring the elongated intermediate products b2*b* of the second casting line 2*b* in a first direction from the second casting line 2*b* to the first casting line 2*a*.

Second moving means allow transferring the elongated intermediate products b2*b* of the second casting line 2*b* in a second direction from the at least second casting line 2*b* to a cooling bed 40. Such second moving means can be substantially the same as the first moving means and can differ from the latter just in that they are driven in the opposite direction as the first moving means.

Figure 7:
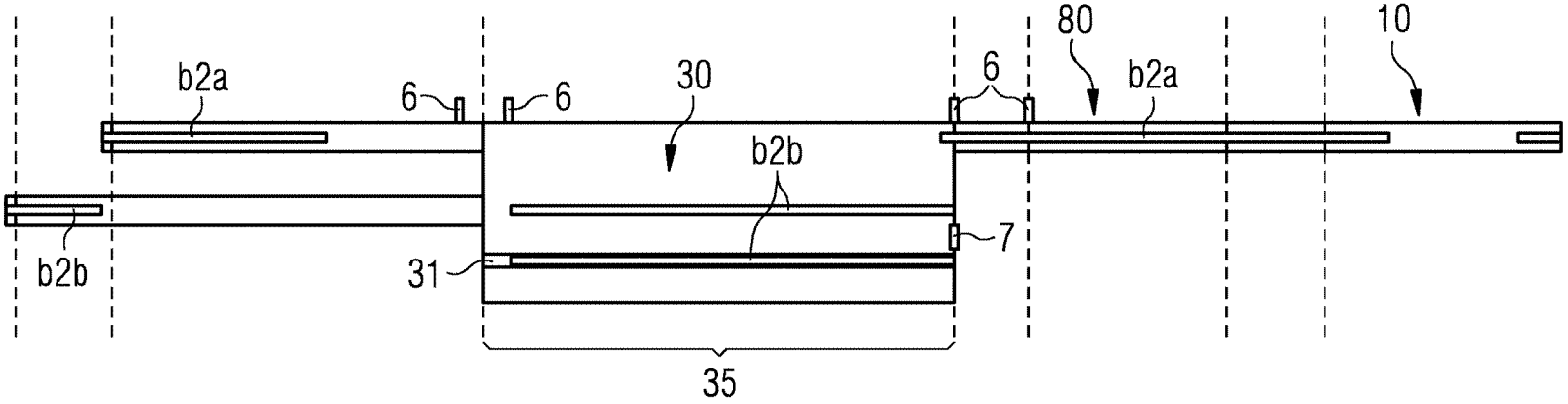
FIG. 7 is a schematic representation of one of the steps which can be performed by the lifting apparatus of FIG. 6 when two elongated intermediate products find themselves concurrently within the cross-transfer area along the second casting line, showing how the lifting device engages with and carries one of the elongated intermediate products to be transferred to a cooling bed.

In order to keep the overall apparatus 100 compact and to advantageously save space, all of the components of the bidirectional transfer means 30 according to the present invention are preferably positioned over one, same cross-transfer area 35 in FIGS. 2, 6 and 7. This means, for the specific embodiment introduced, that the lifting device 31 the first moving means and the second moving means are preferably positioned over one, same cross-transfer area 35.

Lifting device 31 and moving means are therefore spatially contained and grouped within a cross-transfer area or module, which can have walls or can be entirely open-air, substantially at the same level along the first and second casting lines. Being at the same level with respect to the development of the casting lines means substantially at the same plant section. In the context of the present invention, the above mentioned same-level positioning preferably implies that the components of the double-acting transfer means are contained within a cross-transfer area or module substantially at the same distance from the casting mold or casting head of the casting station.

The cross-transfer area 35 preferably stretches over a length which is the same as, or slightly longer than, the rated maximum length of the elongated intermediate products b2*b*.

Thus, valuable space is gained and two functions, corresponding to the double acting transfer means, are advantageously encompassed within the same plant section.

The apparatus 100 according to the present invention comprises an automation control system in FIGS. 2, 6 and 7 comprising special sensor means 6, 7, cooperating with the bidirectional transfer means 30.

In any event, sensor means 6 are advantageously provided at least along the first casting line 2*a*.

The bidirectional transfer means 30 can be thus activated according to information collected by these sensors 6, 7.

Sensors 6,7 can be generic optical presence sensors, or more specifically, can be hot metal detectors designed to detect the light emitted or the presence of hot infrared emitting bodies, such as billets coming from continuous casting.

Sensors 6 along the first casting line 2*a* are preferably positioned within the cross-transfer area 35 and within a range of 1-6 meters upstream of the entrance to the cross-transfer area 35. The former range upstream of the entrance to the cross-transfer area depends on typical billet length, typical billet speed and acceleration or deceleration thereof.

According to a favorite embodiment, at least three such sensors 6 are provided on the first casting line 2*a:*

- one first sensor 6 is positioned before the entrance of the cross-transfer area 35;
- one second sensor 6 is positioned soon after, the entrance of the cross-transfer area 35; and
- one third sensor 6 is positioned at the exit of the cross-transfer area 35.

Figure 5:
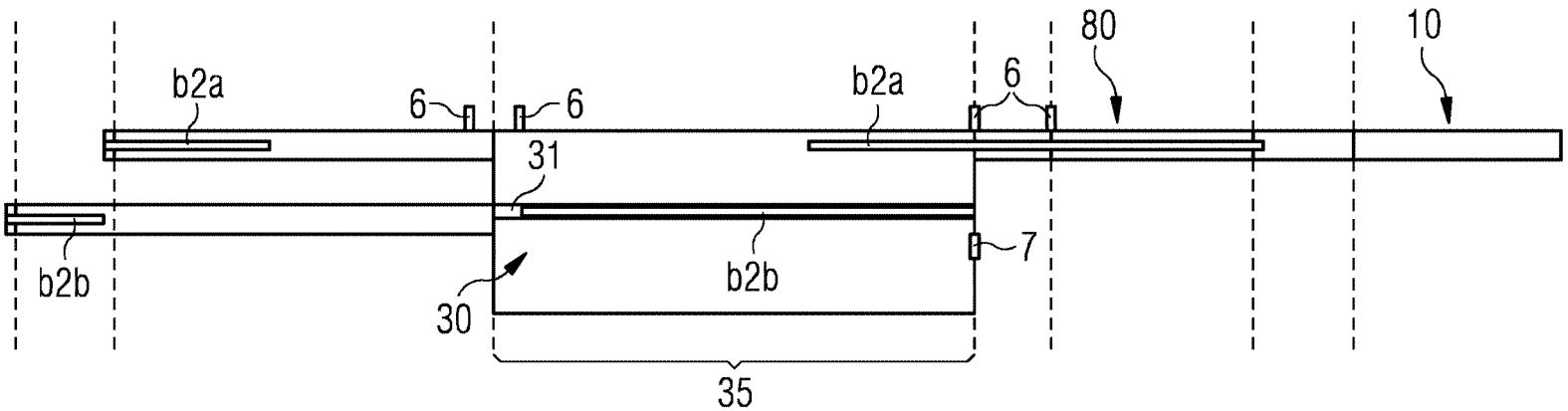
FIG. 5 is a schematic representation of one of the steps which can be performed by the apparatus of FIG. 1, based on sensor means' input, showing how one elongated intermediate product from the second casting line is kept within a cross-transfer area, until next minimal conditions of non-interference are verified on the first casting line for concurrent transfer to the first casting line.

According to another embodiment represented in FIG. 2 and in FIGS. 5-7, at least a further sensor 7 is provided on the second casting line 2*b*, preferably connected to sensor means 6 along the first casting line 2*a* and positioned at the exit of the cross-transfer area 35. Sensor 7 can determine when billets b2*b* have entered and effectively completed their insertion process within the cross-transfer area 35. The cooperation between sensors 6 and 7 can efficiently activate the bidirectional transfer means 30.

A production method according to the present invention comprises a first step of casting from a casting station 20 a multiplicity of strands on respective casting lines, wherein the multiplicity of casting lines comprise at least a first and a second casting line 2*a*, 2*b*, for producing respective elongated intermediate products.

Such elongated intermediate products are obtained by cutting the respective continuously cast strands.

On the first casting line 2*a*, a respective strand or respective elongated intermediate products b2*a* can be moved directly to feed a rolling mill 10; whereas on the second casting line 2*b* the respective elongated intermediate products b2*b* are moved in non-alignment with the rolling mill 10, up to a cross-transfer area 35.

The relative movement of the billets b2*a*, b2*b* on the two different casting lines 2*a*, 2*b* is preferably staggered so as to more easily create the necessary gaps for semi-endless functioning.

The above sensor means are then used as follows. Sensor means 6, 7 detect the presence and the position of strands or of elongated intermediate products, such as billets, and transmit a proportional signal to an overall automation control system. Such automation control system, based on the input received, accordingly activates the bidirectional transfer means 30.

The automation control system cooperates with the bidirectional transfer means 30 in the sense of determining, based on conditions detected by the sensors, the shifting of elongated intermediate products b2*b* into the first casting line 2*a* or towards a cooling bed 40 or, rather, the transitory stop thereof on casting line 2*b*.

The automation control system can advantageously take into account billet positions along first and second casting lines 2*a*, 2*b*; relative distances between billets b2*a* and billets b2*b* in their scattered movements; and speeds thereof, as well as, optionally, billets' dimensions.

In particular, sensor means 6, 7 allow the automation control system to automatically determine whether minimal conditions of non-interference between elongated intermediate products are satisfied on the first casting line 2*a*.

If such given minimal conditions of non-interference are satisfied, then the automation control system activates the bidirectional transfer means 30 to complement the elongated intermediate products which already are moving on the first casting line with additional elongated intermediate products b2*b* from the second casting line 2*b* by cross-transferring elongated intermediate products b2*b* from the second casting line 2*b* to the first casting line 2*a*. Whenever a sufficiently large gap between successive elongated intermediate products on the first line 2*a* is detected, then, a further elongated intermediate product b2*b* is shifted in a first direction, from the second casting line 2*b* to the first casting line 2*a*. Analogously, if a multiplicity of casting lines are provided which comprises more than two casting lines as exemplified, further elongated intermediate products can be shifted from an nth line to the first casting line 2*a* aligned with the rolling mill 10.

In this case, elongated intermediate products b2*b*, cross-transferred from the second casting line 2*b* as exemplified in the intermediate passage of FIG. 2, are eventually fed to the rolling mill 10, to be rolled in series with the elongated intermediate products which move along the first casting line 2*a*. This overall work-flow is schematically represented in the sequence of FIGS. 3A-3E.

FIG. 6 illustrates the completion of the cross-transfer of a billet b2*b* by transfer means 30, wherein the subsequent repositioning of the lifting device 31 is also evident. In fact, the method according to the present invention comprises an intermediate step of repositioning the bidirectional transfer means 30 used for executing the steps of

- cross-transferring the elongated intermediate products from the second casting line 2*b* to the first casting line 2*a*; and
- transferring the elongated intermediate products b2*b* which have reached the cross-transfer area 35 on the second casting line 2*b* to a cooling bed 40. See sequence in FIGS. 4A-4E. The intermediate repositioning step comprises bringing the bidirectional transfer means 30 back to a waiting position along the second casting line, in order to receive a further elongated intermediate product b2*b* entering the cross-transfer area 35 at casting speed or at an accelerated speed of up to 50 meters per minute.

A desired moving or shifting time for cross-transfer execution by transfer means 30 is of less than 20 seconds, preferably less than 15-12 seconds. Preferably, the whole execution cycle of the following operations is comprised within such time ranges: acceleration of the billets b2*b* from their standstill, waiting position on line 2*b* to their cross-transfer speed; placement of the billets b2*b* on the first casting line 2*a* by the transfer means 30; and completion of the release of billets b2*b* on the first casting line 2*a*, such that it may be accelerated towards the rolling mill entry.

Otherwise, if the result of sensor detection and elaboration by the control system is that such given minimal conditions of non-interference are not satisfied, the system determines between two possible commands to be imparted to the bidirectional transfer means 30, in consideration of detection of subsequent, incoming elongated intermediate products b2*b* on said second casting line 2*b*.

These conditions may, for instance, be given also when the first casting line 2*a* is functioning according to an endless operating mode and the strand continuously cast on line 2*a* is not cut into billets for a certain time span but is instead moved uncut to the rolling mill 10. In such conditions and for the whole phase wherein an endless operating mode is adopted, no inter-billet gaps will be found on line 2*a*.

As shown in FIG. 5, the bidirectional transfer means 30 can be instructed to keep the elongated intermediate products b2*b* which have reached said cross-transfer area 35 on the second casting line 2*b* within the cross-transfer area 35, until next minimal conditions of non-interference are verified on the first casting line 2*a* for concurrent transfer to the first casting line 2*a* as above explained.

If, instead, the control system determines that further keeping the elongated intermediate products b2*b* on the second casting line 2*b* within the cross-transfer area 35 will entail risk of collision or interference or cobbles due to the impending arrival of a billet or even of a still uncut strand from casting line 2*b*, the bidirectional transfer means 30 can be instructed to transfer and shift the elongated intermediate products b2*b* which have reached the cross-transfer area 35 on the second casting line 2*b* to a cooling bed 40, for subsequent sale as intermediate products.

This case is exemplified in the work-flow sequence of FIGS. 4A-4E and in FIG. 7. These billets which are let cool down on the cooling bed 40 can alternatively be used for later rolling by the rolling mill 10, particularly in times of non-availability of the casting station 20, instead of being directly sold as such.

In the apparatus according to the present invention, moreover, the automation control system can determine, based on input from the sensor means 6, 7, the variation of the casting speed of the strand of the first casting line 2*a* and/or the variation of the casting speed of the strand of the second casting line 2*b*.

In addition, or in alternative, to the above mentioned casting speed variation for the cast strands, the automation control system of the present apparatus may also encompass the option of controlling acceleration and/or deceleration and/or stopping of elongated intermediate products b2*a*, b2*b* along the first and second cast lines 2*a*, 2*b*.

By controlled variation of the casting speed of the cast strands and/or of the moving speed of the billets on the respective casting lines, there is more easily regulated a sufficiently large gap between successive elongated intermediate products on the first line, so that effective activation of the bidirectional transferring means 30 for transferring elongated intermediate products b2*b* from the second casting line 2*b* in a first direction onto to the first casting line 2*a* is made possible.

The adjustment of the travelling speed of the billets on the casting lines makes it possible to proportionally increase the number of billets b2*b* which can be transferred to the first casting line 2*a* for hot rolling. Ideally, billets of all strands are accelerated after separating them from their strand by cutting, when operation is according to a semi-endless mode. Following this, the billets can be optionally decelerated to obtain a convenient relative distance between billets extremities, which can be approximately of 0.5-1.5 meters, which is usually called the intermediate billet gap.

In particular, elongated intermediate products resulting from the casting process and moving along the first casting line 2*a* at casting speed may be accelerated, after being separated from the relative strand by cutting via cutting means 9, through the cross-transfer area 35 on their way to an induction heater 80 in FIG. 6, in order to create a big enough gap on the first casting line 2*a* to receive an elongated intermediate product b2*b* from the second casting line 2*b*. Cutting means 9 can for example be a shear tool or a torch cutter.

Analogously, elongated intermediate products b2*b* on the second casting line 2*b* can be accelerated after being separated from the respective strand by cutting via cutting means 9' towards and inside the cross transfer area 35, in order to build up a distance gap from successive elongated intermediate products b2*b* and to synchronise with the abovementioned gap creation on the first casting line 2*a*, so that their shifting to the first casting line 2*a* is made possible.

For example, for billets of a length of 12 meters, a convenient entrance inter-billet gap can be of about 14-15 meters; whereas, for billets of a length of 6 meters, a convenient entrance inter-billet gap can be of about 8-9 meters.

Also, for example, accelerated billets which move at 35 meters per minute, up to maximum 50 meters per minute, can be accelerated by at least 150 meters/min^2, preferably by 180-300 meters/min^2 and even more preferably by 500-1500 meters/min^2. The higher the speeds and accelerations, the more the flexibility to switch between endless and semi-endless operational modes is enhanced.

By varying the relative casting speed of the strand casting process along respective casting lines 2*a*, 2*b*; and/or by varying the speed of the elongated intermediate products resulting from casting and moving along the first casting line 2*a*; and/or by varying the speed of the elongated intermediate products b2*b* resulting from casting and moving along the second casting line 2*b*, a convenient staggering of the relative movement of elongate intermediate products b2*a*, b2*b* on different casting lines can be achieved.

Thus, cross-transferring of elongated intermediate products b2*b* from the second casting line 2*b* to the first casting line 2*a* is made easier and safer in that less prone to cobbles.

Similarly, the sensor means 6, 7 can control the waiting time during which elongated intermediate products b2*b* are kept idle within the cross-transfer area 35 along the second casting line 2*b*. The duration of the above waiting time can be advantageously coordinated with the creation of a sufficient gap on the first casting line 2*a*, as above explained, allowing for shifting of such elongated intermediate products b2*b* from the second casting line 2*b* to the first casting line 2*a*.

As above mentioned, the apparatus according to the present invention preferably comprises heating means 80, in FIGS. 4A, 4E, 5, 6 and 7, for the elongated intermediate products. Such heating means is advantageously positioned separate from the bidirectional transfer means 30 along the production line, in particular preferably downstream from the plant section where the bidirectional transfer means 30 is located. The heating means 80 is preferably an inductive heater, but a gas furnace may be possible, although it is less preferred. In any event, the design of the apparatus 100 according to the present invention is such that no long tunnel or excessively long furnace is interposed between billet shearing and entrance to the rolling mill 10.

The automation control system of the apparatus according to the present invention can control—e.g. by advantageously using sensors 6, 7 in combination with a billet stopping system—the deceleration of the previously accelerated elongated intermediate products in correspondence of the induction heater 80 on the first casting line 2*a*, so that these products reach an optimal temperature for subsequent hot rolling by spending the optimal amount of time passing through the induction heater 80. The power of the induction heater 80 is anyhow preferably set and dimensioned to cope with the additional billets b2*b* which are transferred to the first casting line 2*a*. An optimum compromise needs to be therefore achieved between the reduction of speed through the induction heater 80 and the heating power developed by the induction heater itself. At any rate, the apparatus 100 according to the present invention minimizes heat loss, also thanks to the compact structural solution presented in the following.

The apparatus 100 according to the present invention preferably comprises a first shear tool 9 in FIG. 2 for the elongated intermediate products which are cast on the first casting line 2*a*. As explained above, the first casting line 2*a* can also function in an endless operating mode, in connection with which the continuously cast strand on line 2*a* is not cut. Such a shear tool 9 is preferably positioned just after the casting line's region corresponding to the so called maximum solidification length (calculated in accordance with casting section and maximum speed/throughput). The shearing time can be advantageously less than a second, whereas other cutting techniques such as torch cutting normally require 15-60 seconds, depending mainly on billet cross section and on torch output power. Evidently, such gain in time causes less heat loss of the billets while travelling along the casting lines, and proportionally less heat output required from induction heater 80. The apparatus 100 according to the present invention also comprises a second shear tool 9' in FIG. 2 for cutting the strand continuously cast on line 2*b* into elongated intermediate products b2*b*.

The structure of the apparatus 100 according to the present invention preferably has the distance between the first shear tool 9 and the entrance to the heating means 80 is less than 2.4 times the rated maximum length of the elongated intermediate products, and preferably less than 2 times the rated length of the elongated intermediate products. This construction measure further enhances the energy saving characteristics of the apparatus 100 according to the present invention. For example, an apparatus according to the present invention would make an arrangement of a plant for production and rolling of billets measuring 18 meters possible, wherein the overall distance between the shear tool 9 and the end of the cross-transfer area 35 is only about 34 meters; or the overall distance between shear tool 9 and entry to the heating means 80 is only about 37 meters. This would be achieved while still having good further safety/robustness margins, for instance taking into account the vacant space between the head or forward extremity of the first incoming billet b2*a* on line 2*a* in FIG. 2 and the first sensor 6.

In case there is no inductive heater installed, the distance between the first cutting tool after final solidification on the first billet strand 2*a* up to entry into the first rolling stand can even be made less than 2.7 times the maximum rated billet length, preferably less than 2.4 times the maximum rated billet length, when considering a semi-endless operation mode. This configuration can still allow space for a snap shear and/or a descaling unit placed between the end of the cross-transfer area 35 and the first rolling stand 5.

According to an embodiment of the apparatus 100 according to the present invention, moving means for transferring elongated intermediate products b2*a* of the first casting line 2*a* to an emergency bed 4 in FIG. 1 can be also provided.

Such an emergency cooling bed 4 is preferably positioned substantially opposite, with respect to the casting line direction, to the cooling bed 40 for the elongate intermediate products b2*b* from the second casting line 2*b*. The emergency cooling bed 4 as above defined might be useful, for instance, in case a cobble condition occurs in the rolling mill 10; or if quality issues arise and the billets moving along the first casting line 2*a* are not suitable for immediate rolling. Preferably, up to 6 or 10 billets can be shifted aside on the emergency cooling bed 4 from the first casting line 2*a*, for sale or for later back-shifting and semi-endless rolling.

Such moving means for transferring elongated intermediate products b2*a* of the first casting line 2*a* to an emergency bed 4 can be separate from the bidirectional transfer means 30. The decoupling of the above moving means from the bidirectional transfer means 30 can be advantageous in case the transfer means are faced with high operational demand in transferring elongated intermediate products b2*b*.

Alternatively, such further moving means can be comprised in bidirectional transfer means 30 or therewith combined, for instance cooperating with said lifting device 31.

The apparatus 100 according to the present invention, and the method of operating such an apparatus, effectively achieve maximization of rolling throughput by:

- optimizing the entry sequence of additional billets to be finally rolled, when functioning according to a semi-endless operation mode;
- allowing seamless, prompt switching to an endless operation mode on the line which is directly linked to the rolling mill;
- concurrently, rationalizing intermediate billet production and storing, when dictated by production requirements or when critical conditions arise.

Moreover, relative to the semi-endless operation mode, the present invention guarantees minimization of heat loss along the casting lines on the way to the billet heating means; and a minimization of inter-billet gaps, in total safety and preventing billet collisions/interferences or cobbles.

The invention claimed is:

1. An apparatus for production of elongated metal products, the apparatus comprising:

- a rolling mill comprising a rolling stand;
- a casting station comprising a first casting line and a second casting line, each casting line being configured and operable to produce respective continuous strands and elongated intermediate products wherein:
- the first casting line is directly aligned with the rolling mill, such that the first casting line is configured to feed the rolling mill with continuous casting strands or cast elongated intermediate products; and
- the second casting line is not aligned with the rolling mill; and
- a bidirectional transfer device configured for transferring elongated intermediate products of the second casting line in a first direction from the second casting line to the first casting line to align the transferred elongated intermediate products with the rolling mill or to transfer the elongated intermediate products in a second direction from the second casting line to a cooling bed.

2. The apparatus according to claim 1, further comprising a cross-transfer area wherein the bidirectional transfer device is positioned over the cross-transfer area, the cross-transfer area having components substantially at the same level along the first and the second casting lines.

3. The apparatus according to claim 1, further comprising an automation control system comprising first sensors at least along the first casting line cooperating with the bidirectional transfer device.

4. The apparatus according to claim 3, further comprising a second sensor device along the second casting line, and connected to the first sensor along the first casting line.

5. The apparatus according to claim 4, wherein the automation control system is configured to determine, based on input from the sensors;

variation of a casting speed from the casting station on the first casting line and/or on the second casting line; and/or acceleration and/or deceleration and/or stopping of elongated intermediate products along the first and/or the second casting line.

6. The apparatus according to claim 1, further comprising a heating device for the elongated intermediate products, the heating device being positioned separately from the bidirectional transfer device and downstream from the bidirectional transfer device.

7. The apparatus according to claim 6, further comprising a first shear tool configured for shearing the elongated intermediate products on the first casting line, wherein a distance between the first shear tool and the entrance to the heating device is less than 2.4 times the rated maximum length of the elongated intermediate products.

8. A method for producing elongated metal products by operating the apparatus according to claim 1, the method comprising the steps of:

casting from a casting station a multiplicity of casting strands on respective casting lines, the multiplicity of casting lines comprising at least a first and a second casting line, for producing elongated intermediate products, wherein:

the first casting line moving a respective casting strand at the first casting line to directly feed a rolling mill or moving respective elongated intermediate products directly to feed a rolling mill; whereas the second casting line moving respective elongated intermediate products at the second casting line without the respective elongated intermediate products being in alignment with the rolling mill up to a cross-transfer area;

detecting by a sensor device whether selected minimal conditions of non-interference between elongated intermediate products are satisfied on the first casting line;

if the selected minimal conditions of non-interference are satisfied, complementing first of the elongated intermediate products which move on the first casting line with second elongated intermediate products from the second casting line by cross-transferring within a cross-transfer area the elongated intermediate products from the second casting line to the first casting line;

feeding the elongated intermediate products, which have been cross-transferred from the second casting line, to the rolling mill, to be rolled in the rolling mill in series with the elongated intermediate products on the first casting line; whereas if the selected minimal conditions of non-interference are not satisfied, determining, in consideration of detection of subsequent, incoming elongated intermediate products on the second casting line, between the steps of:

keeping the elongated intermediate products which have reached the cross-transfer area on the second casting line within the cross-transfer area, until next minimal conditions of non-interference are verified on the first casting line for transfer to the first casting line and for subsequent rolling; or transferring the elongated intermediate products which have reached the cross-transfer area on the second casting line to a cooling bed.

9. The method according to claim 8, further comprising:

cross-transferring the elongated intermediate products from the second casting line to the first casting line; and transferring the elongated intermediate products which have reached the cross-transfer area on the second casting line to a cooling bed, the cross-transferring and the transferring are executed substantially spatially at the same level along the first and second casting lines, within the cross-transfer area.

10. The method according to claim 8, further comprising an intermediate step of repositioning the bidirectional transfer device used for executing the steps of:

cross-transferring the elongated intermediate products from the second casting line to the first casting line; and transferring the elongated intermediate products which have reached the cross-transfer area on the second casting line to a cooling bed; and the intermediate repositioning step comprising bringing the bidirectional transfer device back to a waiting position along the second casting line, in order to receive a further elongated intermediate product entering the cross-transfer area.

11. The method according to claim 8, further comprising heating the intermediate products moving along the first casting line, the heating following and being separate from the cross-transferring of elongated intermediate products from the second casting line to the first casting line.

12. The method according to claim 8, further comprising varying the casting speed of the strand on the first casting line and/or the casting speed of the strand on the second casting line, wherein the variations in the casting speed in the first casting line and/or the second casting line produce spaces between ends of the elongated intermediate products on at least one of the first and the second casting lines such that the intermediate products on one of the first and the second casting lines may be transferred to the other of the first and second casting lines, wherein the transferred product from the one casting line may be transferred between two of the products on the other of the casting lines.

13. The method according to claim 8, further comprising varying the speed of the elongate intermediate products resulting from casting and from moving along the first casting line; and/or the step of varying the speed of the elongate intermediate products resulting from casting and moving along the second casting line.

* * * * *